United States Patent [19]

Angelini et al.

[11] 4,376,792

[45] Mar. 15, 1983

[54] METHOD FOR PRIMARY CONTAINMENT OF CESIUM WASTES

[75] Inventors: Peter Angelini; Walter J. Lackey, both of Oak Ridge; David P. Stinton, Knoxville; Raymond E. Blanco, Oak Ridge; Walter D. Bond, Knoxville; Wesley D. Arnold, Jr., Oak Ridge, all of Tenn.

[73] Assignee: The United States of America as represented by the United States Department of Energy, Washington, D.C.

[21] Appl. No.: 298,969

[22] Filed: Sep. 3, 1981

[51] Int. Cl.[3] ..... G21C 3/06

[52] U.S. Cl. ..... 427/6; 252/628; 252/629; 210/682; 427/5

[58] Field of Search ..... 210/682; 252/628, 629; 427/5, 6

[56] References Cited

U.S. PATENT DOCUMENTS

| | | | |
|---|---|---|---|
| 2,616,847 | 11/1982 | Ginell | 210/682 |
| 3,101,998 | 8/1963 | Millikein | 252/629 |
| 3,153,566 | 10/1964 | Spector | 252/629 |
| 3,364,148 | 1/1968 | Kivel | 252/644 |
| 4,172,807 | 10/1979 | Larker | 252/629 |

FOREIGN PATENT DOCUMENTS

| | | | |
|---|---|---|---|
| 1456980 | 12/1976 | United Kingdom | 252/628 |

*Primary Examiner*—Sam Silverberg

*Attorney, Agent, or Firm*—Clay C. Carter; Stephen D. Hamel; Richard G. Besha

[57] ABSTRACT

A method for producing a cesium-retentive waste form, characterized by a high degree of compositional stability and mechanical integrity, is provided by subjecting a cesium-loaded zeolite to heat under conditions suitable for stabilizing the zeolite and immobilizing the cesium, and coating said zeolite for sufficient duration within a suitable environment with at least one dense layer of pyrolytic carbon to seal therein said cesium to produce a final, cesium-bearing waste form. Typically, the zeolite is stabilized and the cesium immobilized in less than four hours by confinement within an air environment maintained at about 600° C. Coatings are thereafter applied by confining the calcined zeolite within a coating environment comprising inert fluidizing and carbon donor gases maintained at 1,000° C. for a suitable duration.

2 Claims, 2 Drawing Figures

METHOD FOR PRIMARY CONTAINMENT OF CESIUM WASTES

BACKGROUND OF THE INVENTION

The present invention relates to primary containment of nuclear wastes and, more particularly, to containment of cesium. This invention is a result of a contract with the United States Department of Energy.

Reprocessing operations for irradiated nuclear fuels generate fission product solutions containing numerous radioactive species of metals including cesium. Current management practices for the safe disposal of these solutions call for their conversion to solid forms and subsequent storage in geological formations. It is desirable that losses of these radioactive species be held to a minimum during operations to process, handle, package, and store these wastes.

It is known that retention of cesium is difficult during such processes. It is also known that the presence of cesium during these operations can have an adverse effect on the resultant waste form and the acceptability of the process. Properties of cesium, such as high volatility and solubility, make it difficult to incorporate into traditional processes for solid waste forms of glass, asphalt, cement, concrete, metal, or alternate ceramics. Cesium escape is undesirable due to the hazard to the biosphere presented by its toxicity. Because of the long half-life of cesium, it is anticipated that insoluble waste forms of a high compositional stability and retentivity must be employed for biosphere protection which provide such features for hundreds of years. Preferably, these solid waste forms should also be capable of withstanding the most adverse of conditions that may be encountered in a geological repository.

Therefore, the past approach for dealing with cesium, and like compounds having similar properties such as strontium, has been to isolate them from the fission product solution for separate storage and disposal. Typically, this is accomplished by contacting the fission product solution with a cesium-selective zeolite which will retain cesium by an ionic charge. The resultant fission product solution is thereafter processed by conventional waste immobilization processes. However, an efficient solid waste form for cesium has been difficult to deploy because of the high leach rate and the volatility of cesium from solidified wastes.

Cesium-loaded zeolites are unacceptable as a final waste form because of the reversible nature of the ion-exchange reaction between the zeolite and cesium. Accordingly, cesium-loaded zeolites have been under storage in some locations for up to thirty years awaiting the development of a more permanent and retentive solid waste form for cesium.

SUMMARY OF THE INVENTION

It is an object of this invention to provide a method for immobilizing radioactive cesium within a solid waste form of high mechanical integrity and retentivity which is impervious to adverse conditions which might be encountered in a geological repository.

It is a further object to provide a solidification method which is compatible with existing methods for recovering radioactive cesium from irradiated nuclear fuels while reducing the ultimate storage volume for the resultant article.

It is an additional object to provide such a method which is amenable to continuous processing within a remotely operable and maintainable facility.

Generally, these and other objects are satisfied by the present invention which is a method for producing a cesium-retentive waste form characterized by a high degree of compositional stability and mechanical integrity comprising the steps of subjecting a cesium-loaded zeolite to heat under conditions suitable for providing a body of immobilized cesium within stabilized zeolite, and coating said zeolite within a suitable environment for sufficient duration with at least one dense layer of pyrolytic carbon to seal said cesium as a final, cesium-bearing waste form. Of course, efficiency and economics suggest working with large amounts of zeolite in batch or continuous quantities.

The cesium-loaded zeolite treated by the subject method can be prepared in conventional ion-exchange procedures known within the art. Alternatively, it can be a previously loaded zeolite retrieved from storage such as can be found at the DOE Savannah River Plant at Aiken, S.C. Virtually any commercially available zeolite can be used in this method provided that it possesses the requisite specificity and capacity for adsorption of cesium. For example, commercial zeolites from the following suppliers are thus suitable: (1) Ionsiv IE-95, Union Carbide Corporation, New York, N.Y., (2) Type 5A, Davidson Chemical Division, W. R. Grace and Company, Baltimore, Md.

Procedures for chemical vapor deposition of pyrolytic carbon are known, but must be carried out under the conditions described below to avoid volatilization of cesium or melting of the zeolite to an inoperative mass. Once the first pyrolytic carbon coating is applied, subsequent coatings of carbon or refractory materials may be applied to increase the impervious nature and insolubility of the ultimate solidified waste. These subsequent coatings are not as temperature restrictive as the first since the first carbon layer seals the body. The final waste form may be packaged by traditional procedures in caninsters or monoliths of glass, asphalt, cement, concrete, metal or ceramics.

DETAILED DESCRIPTION

Figure 1:
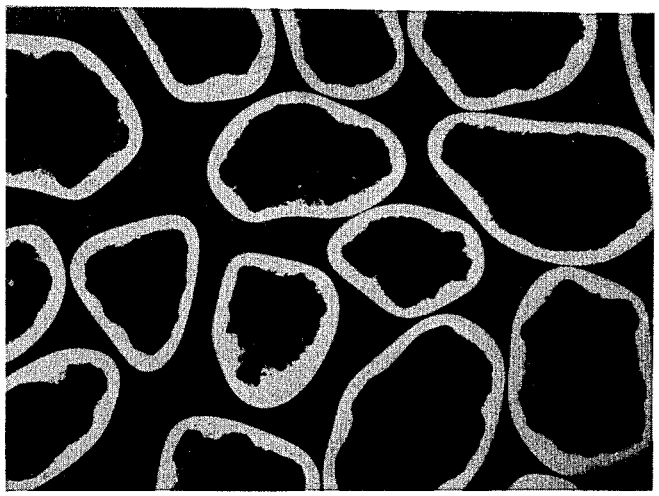

According to the present invention, cesium wastes are processed into solidified waste forms suitable for disposal by long-term storage in geological formations. The ultimate waste form is characterized by a high degree of mechanical integrity and retentivity. It is produced by treating particles of ion-exchange zeolites containing radioactive cesium waste to create a permanently-sealed, impermeably-coated, waste form of the requisite mechanical and chemical characteristics.

The present invention is a method lending itself to continuous operation within a remotely operable facility. Such facilities are essential in processing radioactive wastes, such as cesium compounds, to minimize harmful exposures of humans or the biosphere to the high activity of these compounds. The subject method comprises the following steps, in combination:

1. Subjecting a cesium-loaded zeolite to heat under conditions sufficient to provide a body of immobilized cesium within stabilized zeolite; and
2. Coating said subjected zeolite with at least one dense layer of pyrolytic carbon by confining it for sufficient duration within a suitable pyrolytic carbon coating environment to produce a cesium-retentive waste form.

Examination of cesium-zeolites reveals that ion-exchange processes retain the cesium within the open structure of the material by only an ionic charge. These zeolites contain significant amounts of moisture and volatile matter. Cesium can be lost from the zeolite through disruption of the ionic charge by reversal of the ion exchange process, by addition of competing ions, or by flooding the loaded resin with an acidic solution. Cesium can also be lost by drying or calcining the zeolite at elevated temperatures under thermodynamic conditions likely to result in the formation of highly volatile $Cs_2O$ or Cs metal. Thus, cesium-loaded zeolites by themselves are unsuitable waste forms and are incapable of being directly coated with impervious layers of refractory materials.

We have found that subjecting cesium-loaded zeolites to a rapid heating schedule locks the cesium within a crystalline zeolite structure. The process of cesium fixation within a stabilized zeolite body is believed to occur almost simultaneously but is continued at the ultimate temperature attained by said schedule for up to about four hours to assure safety. This ultimate temperature should be adequate for removing moisture and impurities from the zeolite without causing cesium loss or volatization. Thus, temperatures within the range of about 550° C. to 650° C. are operable within the method of the present invention with about 600° C. preferred. At about 550° C. and below, the zeolite may retain sufficient moisture and impurities to interfere with the application of quality coatings or to provide conditions conductive for cesium loss. Damage to a pyrolytic carbon coating apparatus may even occur when inadequately heated zeolites are coated. Temperatures above about 650° C. are usually unnecessary to accomplish moisture and impurities removal and undesirably approach the boiling point of cesium.

At least one pyrolytic coating is applied to the body by confining it within a pyrolytic carbon coating unit such as a fluidized-bed or drum coater. Attached to the coater are fluid communication means for supplying and contacting one or more of said bodies with an inert carrier gas, such as nitrogen, argon, or helium, and a carbon donor gas, such as acetylene or propylene. Our experiments have indicated good pyrolytic carbon deposition to occur at about 1000° C. While this temperature is lower than that of conventional coating processes, we have obtained satisfactory results at this temperature. Temperatures lower than about 1000° C. have a tendency to produce inadequate decomposition of the carbon donor gas requiring inordinately long times and often resulting in the formation of objectionable organic gases rather than the desired pyrolytic carbon. The presence of extraneous organics has an adverse affect on the quality and density of the resultant coating. Temperatures in excess of about 1000° C. are not normally required since they contribute only minor changes in the efficiency of the donor gas decomposition and may increase the risk of cesium loss.

The ultimate, coated waste form which is recovered from the subject method, is an impervious article suitable for packaging in conventional processes known in the art of radioactive waste disposal. Preferably, large amounts of zeolite are treated in batch or continuous processing modes. Technologies which would have previously been rejected for primary containment of cesium because of its activity can now be applied as redundant containment means since the cesium is tightly encapsulated within the coated bodies.

In order to further demonstrate the operative features of the present invention, the following illustrative examples are provided. It should be noted that granular Ionsiv IE 95 zeolite described below is capable of attaining up to about 5 wt. % loading of Cs while the spherical zeolite Type 5A attain up to about 1 wt. % Cs loading. Other loadings of Cs are expected dependent upon the type of commercial zeolite used and the specificity and capacity of the zeolite for Cs adsorption. Such variations are within the contemplated scope of the appended claims. Zeolites specific for other troublesome radioactive species of metals such as strontium, ruthenium, neodymium, calcium, barium, and molybdenum, may be applied within the scope of the present invention and are contemplated as its equivalents.

EXAMPLE I

Ionsiv IE-95 zeolite was obtained from the Union Carbide Corporation, New York, N.Y. A batch (68.4 g) of these granular zeolite kernels of a 500–600 micron size range was contacted with 11.0 of a combined solution of 2 M $Na_2CO_3$ and 0.007 M CsCl to prepare a cesium-loaded zeolite. Analysis of an air-dried sample of this prepared zeolite showed a loading of about 5 wt. % Cs or 50.4 mg Cs/g zeolite.

The remaining cesium-loaded zeolite was confined in a furnace and rapidly heated to 600° C. at a heating rate of 100° C./hr in air. Once the temperature of 600° C. was attained, it was held for about four hours. Visual inspection of the bodies after cooling to room temperature revealed very little physical change.

A sample (6.0 g) of these bodies was mixed with 20.0 g of $Al_2O_3$ of about the 500 micron size range to give proper fluidization of the zeolite. This charge was confined in a fluidized bed coater (2.5 cm diameter) for sufficient duration for application of a very dense layer of pyrolytic carbon. This coating was applied at 1000° C. using an argon carrier gas for fluidizing and acetylene gas as a carbon donor. Details of the operating parameters and results for this stage are summarized in Table I for a first coating. If greater leach protection is desired, a second coating of denser pyrolytic carbon may be added over the first coating. Conditions for application of a second coating are given in Table I.

TABLE I

| | Coating Conditions | | | | |
|---|---|---|---|---|---|
| Coating Gas Flow Rate ($cm^3$/min) | Fluidizing Gas Flow Rate ($cm^3$/min) | Temperature (°C.) | Run Time (min) | Coating Thickness (TM m) | Coating Density ($g/cm^3$) |
| 1st Coating Acetylene (1000) | Argon (2400) | 1000 | 30 | 30 | 1.9 |
| 2nd Coating Acetylene (500) | Argon (3000) | 1000 | 50 | 15 | 2.0 |

If desired, a third coating of refratory material, such as SiC, $Al_2O_3$, $SiO_2$, $Nb_2O_5$, $ZrO_2$, and their combinations, may be applied to the resultant waste form for enhanced leach-resistance.

FIG. 1 is a micrographic section (50×) of the bodies recovered from our process showing the absence of structural defects and coating-to-body interactions. As can be seen therein, the present invention provides a tightly encapsulated cesium-bearing waste form having a relatively impervious barrier or layer of pyrolytic carbon.

Destructive chemical analysis of the coated cesium bearing waste form showed that greater than 95% of the cesium was retained throughout the complete process. It may be that essentially 100% was retained because the analytical accuracy was only ±5%.

Figure 2:
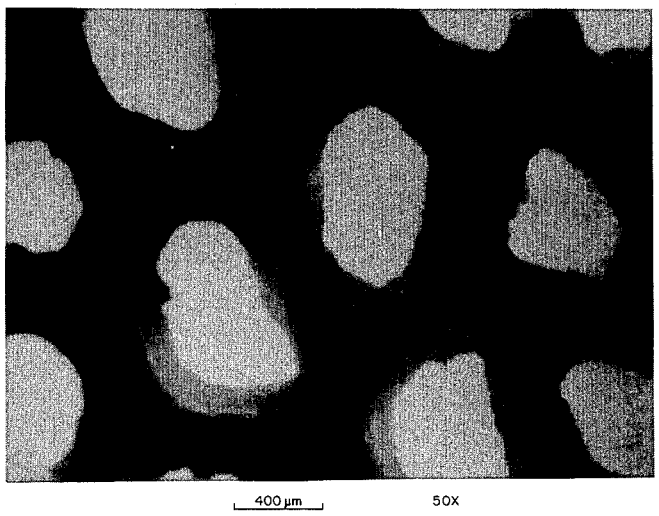

To demonstrate leach-resistance of the ultimate, solidified waste form, a sample of these coated bodies was subjected to a harsh, gaseous chlorine leach test at 1000° C. for six hours. Referring to FIG. 2, a radiographic section (50×) of the leached bodies, no coating degradation or body attack can be observed. The cesium appears to be completely retained within the solidified zeolite structure.

A prolonged, aqueous leach test was performed on a sample of the coated bodies by submerging them in deionized water at 90° C. for three days. The solution was monitored for cesium by atomic adsorption. The Cs content was less than the detection limit for the analytical method. A corresponding leach rate of less than about $1.0\times10^{-3}$ g/m$^2$ day was therefore calculated from the monitored results. This leach rate is at least 5 orders of magnitude less than reported leach-rates for glass encapsulated cesium-bearing waste forms.

EXAMPLE II

The procedures of Example I were repeated using 65.2 g of a spherical zeolite of a 1000 to 2000 micron size range. (Type 5A zeolite, Davidson Chemical Divison, W. R. Grace & Co., Baltimore, MD.

Analysis of an air-dried sample of this cesium-loaded zeolite indicated a somewhat lower cesium loading of about 1.0 wt. %. In all other respects, the ultimate, coated waste form appeared identical to that attained in Example I.

Thus, it will be appreciated by those skilled in the art of radioactive waste immobilization and storage that the present invention provides a highly satisfactory method for prolonged and retentive disposal of cesium compounds.

What is claimed is:

1. A method for producing a cesium-specific waste form, characterized by a high degree of mechanical integrity and compositional stability, comprising, in combination, the steps of:

(a) subjecting a cesium-specific zeolite containing cesium values to a rapid heating schedule within an air environment of about 100° C./hour until a temperature within the range of about 550° C. to 650° C. is attained;

(b) maintaining this temperature for up to about four hours to effect removal of volatiles and moisture from the zeolite thereby retentively immobilizing cesium within stablized zeolite; and (c) coating the zeolite with at least one dense layer of pyrolytic carbon by confinement for sufficient duration within a suitable coating environment operating at about 1,000° C. while utilizing a carbon-donor gas selected from the group consisting essentially of acetylene and propylene and an inert fluidizing gas selected from the group consisting essentially of argon, nitrogen, and helium to effect a solidifed, cesium-retentive waste form.

2. A method for packaging the cesium-retentive waste of claim 1 comprising the step of incorporating said waste form into solid waste processes for storing radioactive wastes, selected from the group of packaging materials consisting of glass, asphalt, cement, concrete, metal, and alternate ceramics.

* * * * *